United States Patent [19]

Coffindaffer et al.

[11] Patent Number: 4,911,852

[45] Date of Patent: Mar. 27, 1990

[54] LIQUID LAUNDRY DETERGENT WITH CURABLE AMINE FUNCTIONAL SILICONE FOR FABRIC WRINKLE REDUCTION

[75] Inventors: Timothy W. Coffindaffer, Loveland; Toan Trinh, Maineville, both of Ohio

[73] Assignee: The Procter & Gamble Company, Cincinnati, Ohio

[21] Appl. No.: 254,983

[22] Filed: Oct. 7, 1988

[51] Int. Cl.[4] ..... C11D 3/30; D06M 11/00

[52] U.S. Cl. ..... 252/8.8; 252/174.15; 252/542; 252/544; 427/393.2; 528/27; 528/28; 528/38; 556/424; 556/425

[58] Field of Search ..... 252/8.8, 174.15, 542, 252/544; 528/27, 28, 38; 556/424, 425; 427/393.2

[56] References Cited

U.S. PATENT DOCUMENTS

| | | | |
|---|---|---|---|
| 3,549,590 | 12/1970 | Holdstock et al. | 260/46.5 |
| 3,576,779 | 4/1971 | Holdstock et al. | 260/29.2 |
| 4,246,423 | 1/1981 | Martin . | |
| 4,416,793 | 11/1983 | Barrat et al. | 252/117 |
| 4,419,391 | 12/1983 | Tanaka et al. | 427/387 |
| 4,477,524 | 10/1984 | Brown et al. | 428/391 |
| 4,541,936 | 9/1985 | Ona et al. | 252/8.6 |
| 4,639,321 | 1/1987 | Barrat et al. | 252/8.8 |
| 4,665,116 | 5/1987 | Kornhaber et al. | 524/268 |
| 4,680,366 | 7/1987 | Tanaka et al. | 528/27 |

FOREIGN PATENT DOCUMENTS

| | | | |
|---|---|---|---|
| 1102511 | 6/1981 | Canada | 8/93.13 |

*Primary Examiner*—Prince E. Willis
*Assistant Examiner*—Alexander Ghyka
*Attorney, Agent, or Firm*—Leonard Williamson; Robert B. Aylor; Richard C. Witte

[57] ABSTRACT

This invention relates to liquid laundry detergent compositions comprising curable amine functional silicones for wrinkle reduction.

15 Claims, No Drawings

LIQUID LAUNDRY DETERGENT WITH CURABLE AMINE FUNCTIONAL SILICONE FOR FABRIC WRINKLE REDUCTION

FIELD OF THE INVENTION

This invention relates to liquid laundry detergent compositions and to a method for treating fabrics for improved wrinkle reduction.

| U.S. Pat. Documents | | | |
|---|---|---|---|
| U.S. Pat. No. | Date | Inventor(s) | Class |
| 3,549,590 | 12/70 | Holdstock et al. | 260/46.5 |
| 3,575,779 | 4/71 | Holdstock et al. | 260/29.2 |
| 4,246,423 | 1/81 | Martin | 556/423 |
| 4,318,818 | 3/82 | Letton et al. | 252/174.12 |
| 4,419,391 | 2/83 | Tanaka et al. | 427/387 |
| 4,477,524 | 10/84 | Brown et al. | 428/391 |
| 4,507,219 | 3/85 | Hughes | 252/118 |
| 4,661,269 | 4/87 | Trinh | 252/8.8 |
| 4,665,116 | 5/87 | Kornhaber et al. | 524/268 |
| SN 136,586 | 12/87 | Coffindaffer et al. | |
| Other Documents | | | |
| EPA 0,058,493 | 8/82 | Ona et al. | |
| Can. 1,102,511 | 6/81 | Atkinson et al. | |

BACKGROUND OF THE INVENTION

In the modern world the vast majority of clothing is made from woven fabrics, and the art of weaving is many centuries old. Indeed the invention of weaving is generally attributed to the Ancient Egyptians. Yarns were produced from natural cotton, wool, or linen fibers, and garments made from fabrics woven from these yarns often creased badly in wear and, when washed, required considerable time and effort with a pressing iron to restore them to a pristine appearance.

With the increasing standard of living, there has been a general demand for a release from the labor involved in home laundering. At the same time the increased cost of labor has raised the expense of commercial laundering considerably. This has resulted in additional pressure being brought to bear on textile technologists to produce fabrics and garments that can be laundered in domestic washing equipment, are then ready to wear, and will keep a good appearance during wear.

Within the last half century, textile manufacturers have implemented two major improvements in wash-and-wear garments: (1) the use of crosslinking resins on cotton containing garments, and (2) the use of synthetics and synthetic blends. Although these two implementations have made major strides in reducing the wrinkling of a garment, consumers are still dissatisfied with the results and feel a need to iron after a laundry operation.

SUMMARY OF THE INVENTION

This invention relates to liquid laundry detergent compositions comprising a curable amine functional silicone (CAFS) agent for fabric wrinkle reduction.

It is, therefore, an object of the present invention to provide liquid laundry detergent compositions which provide superior wrinkle reduction benefits to treated garments. This and other objects are obtained herein, and will be seen from the following disclosure.

DETAILED DESCRIPTION OF THE INVENTION

This invention relates to liquid laundry detergent compositions comprising curable amine functional silicone (CAFS) for fabric wrinkle reduction. In another respect this invention relates to methods of using such curable amine functional silicone compositions in the laundering of fabrics for improved wrinkle reduction. Preferred compositions are aqueous liquids which are added to the wash. Such compositions are usually added to the wash water of a laundering operation. These preferred compositions are organic solvent or aqueous based, water-dispersible liquid detergents which contain from about 0.1% to about 33%, more preferably from about 0.5% to about 20% of the curable amine functional silicone. The compositions are diluted in the wash.

The term "wrinkle reduction" as used herein means that a fabric has less wrinkles after a special cleaning operation than it would otherwise have after a comparable wash and dry operation using the basic laundry detergent. This term is distinguished from a finishing operation used for new textile fabrics as disclosed in U.S. Pat. No. 4,419,391, Tanaka et al., issued Dec. 6, 1983.

In commonly assigned and copending U.S. patent application Ser. No. 136,586, Coffindaffer and Wong, filed Dec. 22, 1987, now allowed, the present invention is disclosed, and incorporated herein by reference.

It is important to differentiate the curable amine functional silicones and the noncurable amine functional silicones. The curable amine functional silicone molecules have the ability to react one with the other to yield a polymeric elastomer of a much higher molecular weight compared to the original molecule. Thus. "curing" often occurs when two CAFS molecules or polymers react, yielding a polymer of a higher molecular weight. [$\sim SiOH + \sim SiOH - - \sim SiOSi \sim + H_2O$]. A more detailed version of the curing reaction is given below. This "cure" is defined herein as the formation of silicone-oxygen-silicone linkages. The silicone-oxygen-silicone linkage cure is distinguished from polysiloxane bridging reactions between amino groups and carboxyl (or epoxy) groups as disclosed in EPA No. 058,493, Ona et al., published Aug. 25, 1982, (Bulletin 82/34).

Curable amine functional silicones are able; e.g., Dow Corning Silicone 531 and Silicone 536, General Electric SF 1706, SWS Silicones Corp. SWS E-210 are commercially available curable amine functional silicones widely marketed for use in hard surface care, such as in auto polishes, where detergent resistance and increased protection are very important.

Unlike curable silicones, noncurable silicones do not have the ability to react with one another and thus maintain a near constant molecular weight. Canadian Patent No. 1,102,511, Atkinson et al., issued June 9, 1981, incorporated herein by reference, discloses noncurable amine functional silicones in liquid fabric softener compositions for fabric feel benefits. It is important to note, however, that Atkinson et al. does not teach curable amine functional silicones (CAFS) in such compositions.

Surprisingly, the curable amine functional silicones plus a suitable carrier to deposit an effective amount of the CAFS on fabric are excellent for fabric wrinkle reduction. Accordingly, several fabric care compositions containing curable amine functional silicones are herein disclosed. Several methods of using curable amine functional silicones for wrinkle reduction fabric care are also disclosed.

The CAFS compositions of this invention are used with a suitable liquid detergent carrier. The term "carrier" as used herein in general means any suitable vehicle (liquid, solid or mechanical) that is used to deliver the CAFS and deposit it on the fabric. This invention comprises a liquid laundry detergent composition comprising the CAFS plus detergent.

In a preferred execution, about 0.1% to about 10% by weight of a curable amine functional silicone is mixed into a suitable commercially available liquid laundry detergent composition. The result is a liquid detergent composition that provides an improved wrinkle reduction benefit to the washed fabric. Suitable commercially available liquid detergent compositions (anionic/nonionic, etc., surfactant based detergent, e.g., Liquid TIDE®, or a nonionic surfactant based detergent, e.g., BOLD3® Liquid). Care must be taken to use CAFS emulsifiers which are compatible with the detergent surfactants to avoid deemulsification of the CAFS. The new liquid detergent/CAFS product of this invention provides an unexpected wrinkle reduction benefit. In the wash, the level of CAFS should be about 1–300 ppm, preferably 5–150 ppm.

Preferably, care should be taken to insure that the compositions of the present invention are essentially free of heavy waxes, abrasives, fiberglass, and other fabric incompatibles.

Curable Amine Functional Silicone (CAFS)

Curable amine functional silicones can be prepared by known methods. U.S. Pat. Nos. 3,549,590, issued Dec. 22, 1970, and 3,576,779, issued Apr. 27, 1971, both to Holdstock et al., and assigned to General Electric Co., and incorporated herein by eference; U.S. Pat. Nos. 3,355,424, Brown, issued Nov. 28, 1967, and 3,844,992, Antonen, issued Oct. 29, 1974, both incorporated herein by reference, disclose methods of making curable amine functional silicones. Useful amino functional dialkylpolysiloxanes and methods for preparing them are described in U.S. Pat. Nos. 3,980,269, 3,960,575 and 4,247,330, whose pertinent disclosures are incorporated herein by reference. Curable amine functional silicones are disclosed in U.S. Pat. No. 4,419,391, Tanaka et al., issued Dec. 6, 1983, incorporated herein by reference.

The curable amine functional silicones of the present invention are preferably essentially free of silicone polyether copolymers disclosed in U.S. Pat. No. 4,246,423, Martin, issued Jan. 20, 1981.

The terms "amine functional silicone" and "aminoalkylsiloxane" are synonymous and are used interchangeably in the literature. The term "amine" as used herein means any suitable amine, and particularly cycloamine, polyamine and alkylamine, which include the curable alkylmonoamine, alkyldiamine and alkyltriamine functional silicones. The term "silicone" as used herein means a curable amine functional silicone, unless otherwise specified.

The preferred CAFS used in the present invention has an initial (before curing) average molecular weight of from at least about 1,000 up to about 100,000, preferably from about 1,000 to about 15,000, and more preferably from about 1,500 to about 5,000. While not being bound to any theory, it is theorized that the lower molecular weight CAFS compounds of this invention are best because they can penetrate more easily into the yarns of the fabric. The lower molecular weight CAFS is preferred, notwithstanding its expense and difficulty in preparation and/or stabilization.

The preferred CAFS of this invention when air dried cures to a higher molecular weight (MW) polymer. The CAFS of this invention can be either branched or straight chained, or mixtures thereof.

The preferred CAFS of this invention has the following formula:

$$((RO)R'_2\,SiO_{\frac{1}{2}})_X\,(R'_2\,SiO_{2/2})_Y\,(R''\,SiO_{3/2})_Z;$$

wherein

X is equal to Z+2;

Y is at least 3, preferably 10 to 35, and is equal to or greater than 3Z;

for a linear CAFS Z is zero;

for a branched CAFS Z is at least one;

R is a hydrogen or a $C_{1-20}$ alkyl; and

R′, R″ is a $C_{1-20}$ alkyl or an amine group; wherein at least one of R′ or R″ is an amine group.

In the more preferred CAFS, R is a hydrogen or a $C_{1-3}$ alkyl; R′ is $C_{1-3}$ alkyl; and R″ is an alkylamine group having from about 2 to about 7 carbon atoms in its alkyl chain.

The value of Y and Z are dictated by the molecular weight of the CAFS. The value of Y is preferably 10 to 35 and the value of Z is preferably 1 to 3.

In the nomenclature "$SiO_{\frac{1}{2}}$" means the ratio of oxygen atoms to silicone atoms, i.e., $SiO_{\frac{1}{2}}$ means one oxygen atom is shared between two silicone atoms.

Preferred curable amine functional silicone agents are in the form of aqueous emulsions containing from about 10% to about 50% CAFS and from about 3% to about 15% of a suitable emulsifier.

General Electric Company's SF 1706 neat silicone (CAFS) fluid is a curable polymer that contains amine functional and dimethyl polysiloxane units.

Typical product data for SF 1706 silicone fluid is:

| Property | Value |
|---|---|
| CAFS content | 100% |
| Viscosity, cstks 25° C. | 15–40 |
| Specific gravity at 25° C. | 0.986 |
| Flash point, closed cup °C | 66 |
| Amine equivalent (milli-equivalents of base/gm) | 0.5 |
| Diluents | Soluble in most aromatic and chlorinated hydrocarbons |

SF 1706 can be diluted to a concentration of from about 0.1% to about 80% and carried to fabrics via a suitable vehicle, e.g., a laundry wash liquor, a rinse liquor, a dry cleaning fluid, a flexible substrate, a spray bottle, and the like.

A particularly preferred CAFS has the following formula:

$$((RO)R'_2\,SiO_{\frac{1}{2}})_X\,(R'_2\,SiO_{2/2})_Y\,(R''\,SiO_{3/2})_Z$$

wherein R is methyl; R′ is methyl; and R″ is $(CH_2)_3\,NH(CH_2)_2\,NH_2$ X is about 3.5; Y is about 27; and Z is about 1.5. The average molecular weight of such a curable amine functional silicone is about 2,500, but can range from about 1,800 to about 2,800. Other useful CAFS materials are disclosed in U.S. Pat. Nos.

4,665,116, Kornhaber et al., issued May 12, 1987 and 4,477,524, Brown et al., issued Oct. 16, 1984.

In use it is believed that the hydrolysis and curing of the CAFS are as follow:

Hydrolysis Step

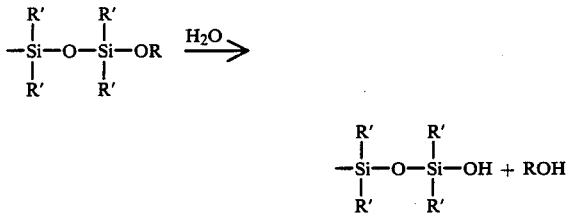

Curing Step

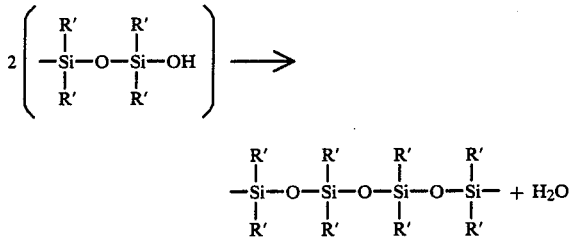

The fabric care composition of this invention comprises a suitable curable amine functional silicone, a surfactant, and, preferably, another fabric care material, e.g., one selected from organic solvents, water, fabric softeners, soil release agents, builders, brighteners, perfumes, dyes, and mixtures thereof.

A specialty aqueous emulsion 124-7300 is made by General Electric Company. It contains 20% SF 1706 and about 5% of a mixture of octylphenoxypolyethoxyethanol and alkylphenylpoly(oxyethylene)glycol emulsifiers.

In preferred executions, the addition of from about 0.1% to about 33%, preferably from about 0.5% to about 20%, and, more preferably from about 1.0% to about 10% of the curable amine functional silicone by weight of the total liquid detergent composition can result in a product that provides outstanding wrinkle reduction benefits when fabric is washed therein in the usual manner.

Detergent Surfactants

The present invention is a liquid detergent composition comprising an effective amount of CAFS and a liquid detergent composition selected from those disclosed in U.S. Pat. Nos. 4,318,818, Letton et al., issued Mar. 9, 1982; 4,507,219, Hughes, issued Mar. 26, 1985; and 4,713,194, Gosselink et al., issued Dec. 15, 1987, all incorporated herein by reference.

The amount of detergent surfactant included in the detergent compositions of the present invention can vary from about 1 to about 75% by weight of the composition depending upon the detergent surfactant(s) used and the type of composition to be formulated. Preferably, the detergent surfactant(s) comprises from about 10 to about 50% by weight of the composition, and most preferably from about 15 to about 40% by weight. The detergent surfactant can be nonionic, anionic, amphoteric, zwitterionic, cationic, or a mixture thereof:

A. Nonionic Surfactants

Suitable nonionic surfactants for use in detergent compositions of the present invention are generally disclosed in U.S. Pat. No. 3,929,678, Laughlin et al., issued Dec. 30, 1975, at column 13, line 14 through column 16, line 6 (herein incorporated by reference). Classes of nonionic surfactants included are:

1. The polyethylene oxide condensates of alkyl phenols. Commercially available nonionic surfactants of this type include Igepal CO-630, marketed by the GAF Corporation, and Triton X-45, X-114, X-100, and X-102, marketed by the Rohm and Haas Company.

2. The condensation products of aliphatic alcohols with from about 1 to about 25 moles of ethylene oxide. Examples of commercially available nonionic surfactants of this type include Tergitol 15-S-9, marketed by Union Carbide Corporation, Neodol 45-9, Neodol 23-6.5, Neodol 45-7, and Neodol 45-4, marketed by Shell Chemical Company, and Kyro EOB, marketed by The Procter & Gamble Company.

3. The condensation products of ethylene oxide with a hydrophobic base formed by the condensation of propylene oxide with propylene glycol. Examples of compounds of this type include certain of the commercially available Pluronic surfactants, marketed by Wyandotte Chemical Corporation.

4. The condensation products of ethylene oxide with the product resulting from the reaction of propylene oxide and ethylenediamine. Examples of this type of nonionic surfactant include certain of the commercially available Tetronic compounds, marketed by Wyandotte Chemical Corporation.

5. Semi-polar nonionic detergent surfactants which include water-soluble amine oxides containing one alkyl moiety of from about 10 to about 18 carbon atoms and 2 moieties selected from the group consisting of alkyl groups and hydroxylalkyl groups containing from 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from 1 to about 3 carbon atoms.

6. Alkylpolysaccharides disclosed in European patent application No. 70,074, R. A. Llenado, published Jan. 19, 1983, having a hydrophobic group containing from about 6 to about 30 carbon atoms, preferably from about 10 to about 16 carbon atoms and a polysaccharide, e.g., a polyglycoside, hydrophilic group containing from about 1½ to about 3, most preferably from about 1.6 to about 2.7 saccharide units.

7. Fatty acid amide detergent surfactants having the formula:

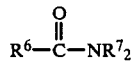

wherein $R^6$ is an alkyl group containing from about 7 to about 21 (preferably from about 9 to about 17) carbon atoms and each $R^7$ is selected from the group consisting of hydrogen, $C_1$–Calkyl, $C_1$–$C_4$ hydroxyalkyl, and $-(C_2H_4O)_xH$ where x varies from about 1 to about 3. Preferred amides are $C_8$–$C_{20}$ ammonia amides, monoethanolamides, diethanolamides, and isopropanol amides.

B. Anionic Surfactants

Anionic surfactants suitable in detergent compositions of the present invention are generally disclosed in U.S. Pat. No. 3,929,678, supra at column 23, line 58 through column 29, line 23 (herein incorporated by reference). Classes of anionic surfactants included are:

1. Ordinary alkali metal soaps such as the sodium, potassium, ammonium and alkylolammonium salts of higher fatty acids containing from about 8 to about 24 carbon atoms, preferably from about 10 to about 20 carbon atoms.

2. Water-soluble salts, preferably the alkali metal, ammonium and alkylolammonium salts, or organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups).

Especially valuable are linear straight chain alkylbenzene sulfonates in which the average number of carbon atoms in the alkyl group is from about 11 to 13, abbreviated as $C_1$–$C_{13}$ LAS.

Preferred anionic surfactants of this type are the alkyl polyethoxylate sulfates, particularly those in which the alkyl group contains from about 10 to about 22, preferably from about 12 to about 18 carbon atoms, and wherein the polyethoxylate chain contains from about 1 to about 15 ethoxylate moieties, preferably from about 1 to about 3 ethoxylate moieties. These anionic detergent surfactants are particularly desirable for formulating heavy-duty liquid laundry detergent compositions.

Other anionic surfactants of this type include sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 unit of ethylene oxide per molecule and wherein the alkyl groups contain from about 8 to about 12 carbon atoms; and sodium or potassium salts of alkyl ethylene oxide ether sulfates containing from about 1 to about 10 units of ethylene oxide per molecule and wherein the alkyl group contains from about 10 to about 20 carbon atoms.

Also included are water-soluble salts of esters of alpha-sulfonated fatty acids.

3. Anionic phosphate surfactants.

4. N-alkyl substituted succinamates.

C. Amphoteric Surfactants

Amphoteric surfactants can be broadly described as aliphatic derivatives of secondary or tertiary amines, or aliphatic derivatives of heterocyclic secondary and tertiaryamines in which the aliphatic radical can be straight chain or branched and wherein one of the aliphatic substituents contains from about 8 to about 18 carbon atoms and at least one contains an anionic water-solubilizing group, e.g., carboxy, sulfonate, sulfate. See U.S. Pat. No. 3,929,678, supra. at column 19, lines 18–35 (herein incorporated by reference) for examples of amphoteric surfactants.

D. Zwitterionic Surfactants

Zwitterionic surfactants can be broadly described as derivative of secondary and tertiary amines, derivatives of heterocyclic secondary and tertiary amines, or derivatives of quaternary ammonium, quaternary phosphonium or tertiary sulfonium compounds. See U.S. Pat. No. 3,929,678, supra at column 19, line 38 through column 22, line 48 (herein incorporated by reference) for examples of zwitterionic surfactants.

E. Cationic Surfactants

Cationic surfactants can also be included in detergent compositions of the present invention. Useful cationic surfactants are disclosed in U.S. Pat. No. 4,259,217, Murphy, issued Mar. 31, 1981, herein incorporated by reference.

Detergent Builders

Detergent compositions of the present invention can optionally comprise inorganic or organic detergent builders to assist in mineral hardness control. When included, these builders typically comprise up to about 60% by weight of the detergent composition. Built liquid formulations preferably comprise from about 1% to about 25% by weight detergent builder, most preferably from about 3% to about 20% by weight, while built granular formulations preferably comprise from about 5% to about 50% by weight detergent builder, most preferably from about 10% to about 30% by weight.

Carriers

Preferred carriers are liquids selected from the group consisting of water and mixtures of the water and short chain $C_1$–$C_4$ monohydric alcohols and/or polyols containing 2–6 carbon atoms. A detailed discussion of solvent systems (carriers) is disclosed in U.S. Pat. No. 4,507,219, supra. at columns 7 and 8.

Optional Components

Optional components for use in the liquid detergents herein include enzymes, enzyme stabilizing agents, polyacids, soil removal agents, antiredeposition agents, suds regulants, hydrotropes, opacifiers, antioxidants, bactericides, dyes, perfumes, and brighteners described in U.S. Pat. No. 4,285,841, Barrat et al., issued Aug. 25, 1981, incorporated herein by reference. Such optional components generally represent less than about 15% preferably from about 2% to about 10%, by weight of the composition.

A more detailed discussion of optional components is found in U.S. Pat. No. 4,507,217, supra at columns 8 and 9.

The compositions of the present invention can be prepared by a number of methods. A convenient and satisfactory method and composition are disclosed in the following nonlimiting example.

EXAMPLE I

In this example, Liquid TIDE®, a commercially available, heavy duty liquid laundry detergent which contains a total of about 28% of active anionic, cationic, and nonionic surfactants, is used. Liquid TIDE is made under U.S. Pat. No. 4,507,219, supra, incorporated herein by reference, particularly Example III, A & B.

Forty grams of emulsified CAFS (25 parts) (20% emulsion of GE SF-1706) (5 parts CAFS) was added to 118 gm of Liquid TIDE (75 parts) with stirring at ambient temperature. This mixture containing about 3% CAFS was then added to the wash cycle which contained a standardized bundle of clothing plus two ironed poly-cotton wrinkle tracing fabrics just as agitation started. Similarly, 118 gm of Liquid TIDE® was added to a second standardized bundle of clothing containing two ironed poly-cotton wrinkle tracing fabrics.

Both loads were washed under normal conditions (warm wash and cold rinse). After completion of the wash cycle, both loads were transferred to matching dryers and dried on the normal cycle. At the end of the drying cycle, the wrinkle tracing fabrics were compared to one another for wrinkles using the following scale:

0=no difference
1=slight difference
2=difference
3=large difference
4=very large difference with positive numbers meaning better than the comparison point and negative numbers meaning worse than the comparison point.

Using the Liquid TIDE without CAFS as the basis for comparison, the following grades were obtained for Liquid TIDE+CAFS:

| Set 1 | Set 2 | Average |
|---|---|---|
| +3 | +2 | +2.5 |

Using the same fabrics, the washing and drying cycles were repeated which gave the following grades for Liquid TIDE+CAFS:

| Set 1 | Set 2 | Average |
|---|---|---|
| +2 | +4 | +3.0 |

The incorporation of an effective amount of a CAFS into any suitable liquid laundry detergent composition improves the wrinkle reduction performance of the compositions and works very well on laundered polyesters, cottons and cotton/polyester blends.

What is claimed is:

1. A liquid laundry detergent composition comprising: (1) a wrinkle reducing level of a suitable curable amine functional silicone agent for wrinkle reduction, (2) an effective amount of a surfactant, (3) a suitable carrier to deposit an effective wrinkle reducing amount of said curable amine functional silicone on said fabric, and (4) a suitable emulsifier, wherein said curable amine functional silicone cures to form silicone-oxygen-silicone linkages; and wherein said surfactant is selected from the group consisting of: anionic, nonionic, amphoteric, zwitterionic and cationic surfactants, and mixtures thereof.

2. The liquid laundry detergent composition of claim 1 wherein said agent is a concentrate which contains from about 0.1% to about 33% by weight of said curable amine functional silicone and wherein said concentrate is diluted when used.

3. The liquid laundry detergent composition of claim 2 wherein said concentrate is an aqueous liquid containing from about 0.5% to about 20% of said curable amine functional silicone and said carrier is primarily water.

4. The liquid laundry detergent composition of claim 2 wherein said concentrate contains from about 1% to about 10% of said curable amine functional silicone.

5. The liquid laundry detergent composition of claim 4 wherein said curable amine functional silicone has an average molecular weight of from about 1,000 to about 100,000.

6. The liquid laundry detergent composition of claim 5 wherein said surfactant is selected from anionic and nonionic and mixtures thereof and is present at a level of from about 10% to about 75% by weight of the total composition.

7. The liquid laundry detergent composition of claim 1 wherein said silicone has an average molecular weight of from about 1,000 to about 15,000.

8. The liquid laundry detergent composition of claim 1 wherein said silicone has an average molecular weight of from about 1,500 to about 5,000.

9. The liquid laundry detergent composition of claim 1 wherein said curable amine functional silicone is selected from the group of linear and branch curable amine functional branch silicones and mixtures thereof having the following structure:

$$((RO)R'_2\,SiO_{\frac{1}{2}})_X\,(R'_2\,SiO_{2/2})_Y\,(R''\,SiO_{3/2})_Z;$$

wherein
X is equal to Z+2; and
Y is at least 3; and
wherein
Z is zero for a linear curable amine functional silicone;
Z is at least one for a branched curable amine functional silicone;
wherein
R is a hydrogen or a $C_{1-20}$ alkyl; and
R′, R″ is a $C_{1-20}$ alkyl or an amine group selected from cyclic amines, polyamines and alkylamines having from about 2 to about 7 carbon atoms in their alkyl chain, and wherein at least R′ or R″ is an amine group.

10. The liquid laundry detergent composition of claim 9 wherein
R is a hydrogen or a $C_{1-3}$ alkyl;
R′ is $C_{1-3}$ alkyl; and
R″ is an alkylamine group having from about 2 to about 7 carbon atoms in its alkyl chain.

11. The liquid laundry detergent composition of claim 10 wherein said R is methyl; R′ is methyl and R″ is $(CH_2)_3NH(CH_2)_2NH_2$; and X is about 3.5; Y is about 27 and Z is about 1.5; and wherein said curable amine functional silicone has a molecular weight in the range of from about 1,000 to about 2,800 and a viscosity of about 5–40 centistokes at 25° C.

12. A method of reducing wrinkles in laundered fabrics comprising: 1 washing said fabrics in a solution containing effective amounts of water, and said composition of claim 1; whereby said curable amine functional silicone is deposited onto said fabrics; (2) rinsing said fabrics and drying said washed and rinsed fabrics to cure said deposited curable amine functional silicone for wrinkle reduction.

13. The method of claim 12 wherein said curable amine functional silicone is present in said solution at a level of from about 1 ppm to about 300 ppm.

14. The method of claim 12 wherein said curable amine functional silicone is present in said solution at a level of from about 5 ppm to about 150 ppm.

15. A liquid laundry detergent composition comprising (1) a wrinkle reducing level of a suitable curable amine functional silicone agent for wrinkle reduction, (2) a wrinkle reducing amount of a surfactant, (3) a suitable carrier to deposit an effective amount of said curable amine functional silicone on said fabric, and (4) a suitable emulsifier; wherein said surfactant is selected from the group consisting of: anionic, nonionic, amphoteric, zwitterionic and cationic surfactants, and mixtures thereof; wherein said curable amine functional silicone cures to form silicone-oxygen-silicone linkages; and wherein said curable amine functional silicone is selected from the group of linear and branch curable amine functional branch silicones and mixtures thereof having the following structure:

$$((RO)R'_2\,SiO_{\frac{1}{2}})_X\,(R'_2\,SiO_{2/2})_Y\,(R''\,SiO_{3/2})_Z;$$

wherein

X is equal to Z+2; and

Y is at least 3; and wherein

Z is zero for a linear curable amine functional silicone;

Z is at least one for a branched curable amine functional silicone;

wherein

R is a hydrogen or a $C_{1-20}$ alkyl; and

R′, R″ is a $C_{1-20}$ alkyl or an amine group selected from cyclic amines, polyamines and alkylamines having from about 2 to about 7 carbon atoms in their alkyl chain, and wherein at least R′ or R″ is an amine group; and wherein said curable amine functional silicone has a molecular weight in the range of from about 1,000 to about 2,800 and a viscosity of about 15–40 centistokes at 25° C.

* * * * *

UNITED STATES PATENT AND TRADEMARK OFFICE

CERTIFICATE OF CORRECTION

PATENT NO. : 4,911,852

DATED : March 27, 1990

INVENTOR(S) : TIMOTHY W. COFFINDAFFER & TOAN TRINH

It is certified that error appears in the above-identified patent and that said Letters Patent is hereby corrected as shown below:

Col. 2, line 47, delete "able" and insert therefor -- commercially available --.

Col. 5, lines 5-16,

"<u>Hydrolysis Step</u>

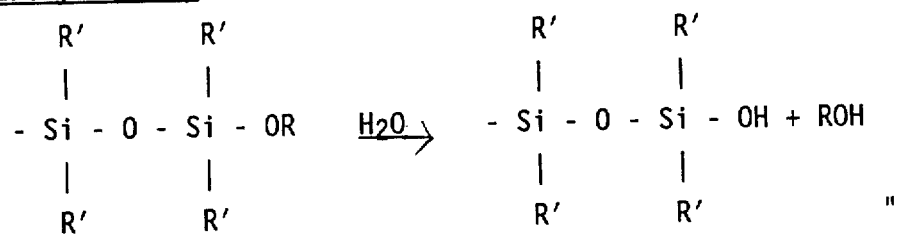

"

should read --

<u>Hydrolysis Step</u>

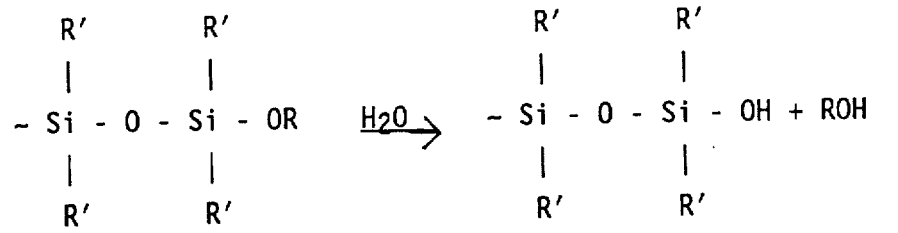

--.

Col. 5, lines 17-19

"<u>Curing Step</u>

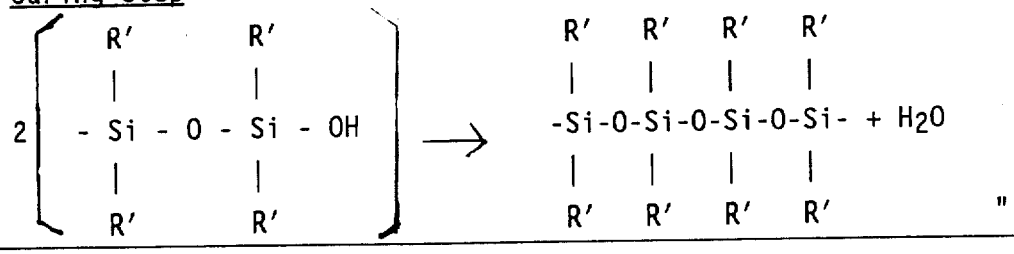

"

UNITED STATES PATENT AND TRADEMARK OFFICE

CERTIFICATE OF CORRECTION

PATENT NO. : 4,911,852

DATED : March 27, 1990

INVENTOR(S) : TIMOTHY W. COFFINDAFFER & TOAN TRINH

It is certified that error appears in the above-identified patent and that said Letters Patent is hereby corrected as shown below:

should read --

Curing Step

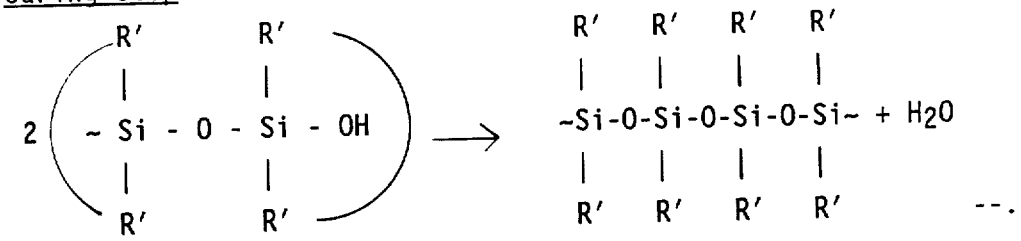

--.

Col. 6, line 66, "$C_1$-Calkyl," should read -- $C_1$-$C_4$ alkyl, --.

Col. 7, line 57, "tertiaryamines" should read -- tertiary amines --.

Col. 8, line 32, before "detailed" insert -- more --.

IN THE CLAIMS:

Col. 10, line 49, "5-40" should read -- 15-40 --.

Col. 10, line 55, after "fabrics" insert -- ; --.

Col. 10, line 55, before "drying" insert -- (3) --.

Signed and Sealed this

Twenty-first Day of January, 1992

*Attest:*

HARRY F. MANBECK, JR.

*Attesting Officer*

*Commissioner of Patents and Trademarks*